US005837414A

United States Patent [19]

Kitani et al.

[11] Patent Number: 5,837,414

[45] Date of Patent: Nov. 17, 1998

[54] TONER FOR DEVELOPING ELECTROSTATIC IMAGE AND METHOD FOR FORMING MULTICOLOR IMAGE

[75] Inventors: Ryuji Kitani; Meizo Shirose; Tatsuya Nagase; Shoichiro Ishibashi, all of Hachioji, Japan

[73] Assignee: Konica Corporation

[21] Appl. No.: 863,332

[22] Filed: May 27, 1997

[30] Foreign Application Priority Data

May 29, 1996 [JP] Japan ..... 8-135013

[51] Int. Cl.[6] ..... G03G 9/08

[52] U.S. Cl. ..... 430/107; 430/109

[58] Field of Search ..... 430/106, 110, 430/109, 107

[56] References Cited

U.S. PATENT DOCUMENTS

| | | | |
|---|---|---|---|
| 5,024,915 | 6/1991 | Sato et al. | 430/110 |
| 5,149,611 | 9/1992 | Kohri et al. | 430/110 |

*Primary Examiner*—John Goodrow

*Attorney, Agent, or Firm*—Jordan B. Bierman; Bierman, Muserlian and Lucas

[57] ABSTRACT

Disclosed is a toner for developing an electrostatic latent image, comprising colored particles containing a colorant and a binder resin, and fine particles, wherein said fine particles have a releasing index of 10 to 50 in terms of a turbidity.

19 Claims, 4 Drawing Sheets

TONER FOR DEVELOPING ELECTROSTATIC IMAGE AND METHOD FOR FORMING MULTICOLOR IMAGE

FIELD OF THE INVENTION

The present invention is related to a toner for developing an electrostatic image and a method for forming a multicolor image, which are employed by a copier, a printer, and the like.

BACKGROUND OF THE INVENTION

Conventionally, to high image quality and high speed imaging apparatuses, in most cases, the electrophotographic imaging method has been applied.

In recent years, color imaging has been increasingly applied to those fields. As a method for forming good multicolor images without causing color doubling with use of compact and low cost multicolor imaging machines, there is known a color imaging method utilizing a so-called KNC process. This multicolor imaging method consists of a series of processes wherein spot exposure using a laser beam, etc. is made to the surface of a uniformly charged imaging member (sometimes termed photoreceptor herein because it is generally used.); an electrostatic latent image is formed; the electrostatic latent image on the imaging member is repeatedly developed under non-contact with a two component developer comprising a colored toner; on the aforesaid imaging member, a plurality of colored toner images different in color are formed as being superimposed; then, the aforesaid plurality of colored toner images are simultaneously transferred and fixed; on the other hand, after transferring, the residual toner which has not been transferred is cleaned before commencing the next copying process.

However, technology of forming multicolor images described above carries the following problems.

In the transfer process, a plurality of colored toner images prepared by colored toners are simultaneously transferred. Then, the adhesion period of the toner which is first developed is different from that of the toner which is lastly developed, and the big difference in physical adhesion strength is caused between the imaging member and the toner. Due to the difference, the transferability of the colored toner first developed is much inferior to those of the toner lastly developed and formed images suffer variation in color.

Furthermore, in a process wherein the residual toner on the imaging member is cleaned with a blade, on account of the difference in the physical adhesion strength, the toner which is hard to remove is gradually accumulated on the imaging member while repeating a copying process tens thousand times. This causes defects such as insufficient cleaning and toner-filming. Particularly, in a non-contact developing process wherein a plurality of colored toners are superimposed on the imaging member, these troubles are subjected to cause image defects.

In order to remedy such drawbacks, several methods have been proposed. However, there has been no method wherein the state of fine particles on the surface of the toner is controlled. Therefore, when fine particles having a number average particle diameter of 0.05 $\mu$m or more are added, a released amount increases due to the decrease in the physical adhesion strength. Aggregates due to this become nuclei and white spots are caused at the transfer process; released particles themselves are not cleaned; cracks are caused on the imaging member and insufficient cleaning is caused such as toner filming, etc.

An object of the present invention is to provide a toner for developing an electrostatic image wherein the strength of adhesion of fine particles on the toner is controlled by the presence of the fine particle on the surface of the toner so that Releasing Index described hereinafter is within the predetermined range. Additionally, another object of the present invention is to provide a method for forming a multicolor image wherein insufficient cleaning of the toner can be prevented in a blade cleaning process while securing the transferring stability at the simultaneous transfer of superimposed multicolored toner images on an imaging member by utilizing the aforesaid toner.

SUMMARY OF THE INVENTION

The aforementioned objects are accomplished by the following embodiments.

(1) In a toner for developing an electrostatic latent image comprising colored particles having at least a colorant and a binder resin, and fine particles, the toner for developing an electrostatic image which is characterized by the range of 10 to 50 of the Releasing Index of the aforesaid particles on the surface of the aforesaid toner.

(2) A method for forming a multicolor image is characterized by comprising processes wherein with use of a plurality of developers comprising the aforesaid toner for developing an electrostatic image described in (1), a developing layer formed on a developer carrying member is transported to a developing zone in such a state that the developing layer has no contact with an imaging member; under a vibrating electric field obtained by applying an alternative bias, an electrostatic latent image on the aforesaid imaging member is repeatedly developed; a plurality of color images different in color formed by different colored toners are formed on the aforesaid imaging member; then, by superimposing, the aforesaid plurality of color images are simultaneously transferred; and the aforesaid developer which remains on the aforesaid imaging member is cleaned by a cleaning blade.

BRIEF DESCRIPTION ON THE DRAWINGS

FIG. 1 is a schematic diagram showing one example of non-contact developing method FIG. 2 is a schematic diagram showing one example of imaging apparatus of the present invention FIG. 3 is a schematic diagram explaining the blade cleaning of the present invention FIG. 4 is a schematic diagram explaining the blade cleaning of the present invention.

FIGS. 5(*a*), 5(*b*) and 5(*c*) are views showing an instrument for measuring Asuka C hardness.

(Explanation of numerals)

11 Charger
12 Developing apparatus
13 Cleaning unit
14 Light-sensitive drum
16 Transporting unit
21 Transferring unit

DETAILED DESCRIPTION OF THE INVENTION

Figure 1:
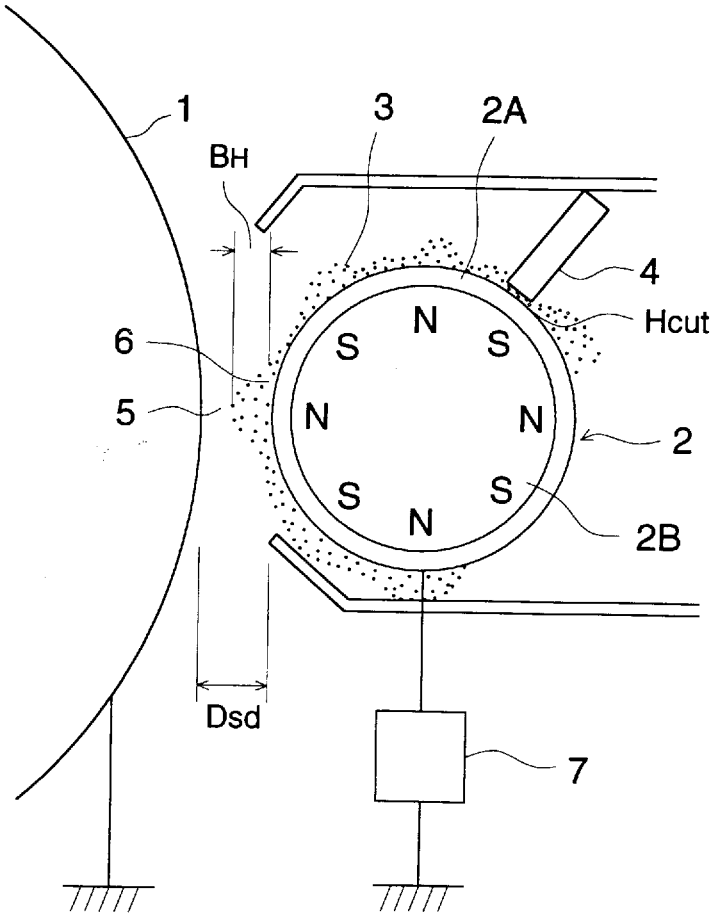

Furthermore, the present invention is explained in detail.

(Fine Particle)

Measuring a number average particle size is carried out by the observation using a transmission electron microscope followed by the image analysis.

A fine particle composition is not specified and any fine particles can be employed.

As materials composing of inorganic fine particles, are preferably employed, for example, various kinds of inorganic oxides, nitrides, borides and the like. Examples include silica, alumina, titania, zirconia, barium titanate, aluminum titanate, strontium titanate, magnesium titanate, zinc oxide, chromium oxide, selenium oxide, antimony oxide, tungsten oxide, tin oxide, tellurium oxide, manganese oxide, boron oxide, silicon carbide, boron carbide, titanium carbide, silicon nitride, titanium nitride, boron nitride, etc.

Furthermore, the above-mentioned inorganic fine particles which are subjected to hydrophobic treatment are preferable. In practice, are preferably employed inorganic fine particles which are subjected to hydrophobic treatment using so-called coupling agents such as various kinds of titanium coupling agents, silan coupling agents, etc., higher fatty acid metal salts such as aluminum stearate, zinc stearate, calcium stearate, etc.

In the present invention, in a case where the inorganic fine particles are subjected to hydrophobic treatment, the hydrophobicity of the inorganic fine particles is expressed in methanol wetability. The methanol wetability is used to evaluate the wetability for methanol. Distilled water of 50 ml is placed in a 250 ml beaker and 0.2 g of particles is weighed and added. Methanol is with stirring slowly added from a burette of which outlet is immersed in the solution until all the particles are wet. The hydrophobicity is calculated by the following formula.

$$\text{Hydrophobicity}=[a/(a+50)]\times 100$$

wherein a is methanol volume in ml necessary for making all the fine particles wet.

In the present invention, the hydrophobicity of the inorganic fine particles is preferably not less than 20.

In addition, when organic fine particles are employed, the compositions are not particularly limited. Generally, are preferably employed vinyl-type organic fine particles, and organic fine particles of melamine-formaldehyde condensation products, polyesters, polycarbonates, polyamides, polyurethanes, etc. This reason is that organic fine particles are readily prepared by preparation methods such as an emulsion polymerization method, a suspension polymerization method, etc.

A number average particle size of the above mentioned fine particles is preferably 0.05 to 0.5 $\mu$m.

In case of a particle diameter of less than 0.05 $\mu$m, because it is not easy to decrease the physical adhesion strength between the toner and the photoreceptor, the transferability is liable to be lowered and as a result, the image density is apt to decrease.

For a particle diameter of more than 0.5 $\mu$m, the fine particles which have been adhered are apt to be released due to physical impacts such as agitation in a developing device, etc. As a result, the released particles are liable to be accumulated in the developing device and are liable to result in recoagulation which is apt to become a nucleus at the transfer to cause a white spot. In addition, because of a large amount of the released component is apt to be adhered onto the surface of a photoreceptor, filming is liable to be caused.

As fine particles which are present on the surface of a toner particle, there are particles which are buried in the toner particle and are fixed onto the surface of the toner particle, and the other particles which are not buried but are adhered electrostatically onto the toner particle. It is estimated that because the fine particles adhered electrostatically onto the toner particle can migrate on the surface of the toner during development process, they contribute to the improvement in fluidity of the whole toner.

Heretofore, it has been considered that an amount of fine particles adhered electrostatically onto the toner affect various developing characteristics of the toner particle. However, there has been no good method of measuring quantitatively an amount of the fine particles adhered electrostatically onto the toner particle. In the present invention, it has been successfully found that the amount of the fine particles adhered electrostatically onto the toner particle is measured quantitatively and is expressed as "Releasing Index" by the procedure wherein the toner is dispersed into liquid comprising a surface active agent followed by the specified centrifugal separation; by measuring turbidity of the separated liquid, the amount of the fine particle adhered electrostatically onto the toner particle is quantitatively measured and the resulting values are expressed as the Releasing Index. When the above-mentioned separation method of the present invention is employed, it is estimated that the fine particles buried onto the surface of the toner particle are not released from the toner particle and the fine particles adhered electrostatically onto the toner particle are released from the toner particle. Furthermore, the kinds and amount of the surface active agent used at the separation are not limited, if no adverse effect results in the turbidity measurement. In the following, one example of the method for measuring the Releasing Index is practically illustrated.

Measurement of the Releasing Index

No surface active agent is particularly specified. For example, may be employed any of nonionic surface active agents, cationic surface active agents and anionic surface active agents. In practice, the nonionic surface active agents include, for example, polyethylene glycol, polypropylene glycol, etc. and the derivatives having a benzene ring, etc. as an end group. In addition, the anionic surface active agents include, for example, alkyl benzene sulfonic acids and the alkali metal salts, polyoxyethylene alkyl ether sulfate salts, etc.

For dispersing a toner, without using particularly ultrasonic wave, the toner is dispersed only with stirring into an aqueous solution containing a surface active agent. This is for dispersing into water only fine particles which effect advantages of the present invention, while preventing the release of the fine particles which are firmly adhered, and however which may be released by the application of energy such as ultrasonic wave.

Conditions for a centrifugal separator are of the preparation for an aqueous solution into which only fine particles are dispersed. In practice, it is preferred that the centrifugal force is from 30 to 300 G and the time is from 5 to 20 minutes.

Light transmission rate is measured at a wavelength of 500 nm.

A practical dispersion method is such that 5.0 g of a toner is put in a 100 ml beaker; then, 50 ml of an aqueous solution containing 1 ml of a 35 percent aqueous solution of alkyl benzene sodium sulfate salt is added; the resulting mixture is stirred for five minutes and the toner is dispersed into water by the aid of the surface active agent. After that, the aqueous solution into which the aforesaid toner has been dispersed is subjected to centrifugal separation using a centrifugal separator. In the conditions, as a device, the 30CFS manufactured by Sakuma Seisakusho is employed and centrifugal separation is conducted at 2,000 rpm (300 G) for 10 minutes. Then, 40 ml of the supernatant liquid is collected; the light transmission rate is measured and the Releasing Index of the present invention is calculated.

The measurement of the light transmission rate was performed with the use of the COH-300A having a halogen lamp as a light source manufactured by Nihon Denshoku Co. The wavelength employed for the measurement is 500 nm.

A turbidity of the supernatant liquid was measured using COH-300A manufactured by Nihon Denshoku Co. Ltd. and was termed the Releasing Index of the fine particle present on the surface of a toner.

Releasing Index: turbidity=scattering component/total transmitted component

When the releasing index is less than 10, the fluidity of the toner is liable to be deteriorated due to the firm adhesion of the fine particle. Then, rolling properties of the toner at the cleaning is liable to be degraded and the cleaning capability is liable to be lowered.

When the releasing index exceeds 50, an amount of the releasing component is apt to increase. Then, released fine particles are liable to be recoagulated in a developing device and are apt to become nuclei at the time of the transferring. As a result, white spots are liable to be caused. Furthermore, because the released component becomes adhesive to the surface of the photoreceptor, filming is liable to be caused.

An amount of the fine particles is preferably from 0.05 to 5.0 weight parts (hereinafter, parts are by weight of the colored particle unless otherwise indicated.) and more preferably from 1.0 to 4.0 parts.

When the amount is less than 0.05 part, it is difficult to obtain the decreasing effect of the physical adhesion strength and the transferability is apt to decrease. When the amount exceeds 5.0 parts, excessive fine particles are apt to be present on the surface of the toner and are easily released due to the effect of agitation in the developing vessel, etc. On account of that, the released is liable to be accumulated in the developing device and in the device, are easily recoagulated to form nuclei which are mixed in developed toner image and white spots are liable to be caused therein. Furthermore, on account of the fact that a large amount of the released component adheres onto the surface of the photoreceptor, toner filming is liable to be caused.

For obtaining the Releasing Index of the present invention, when using an apparatus for mixing fine particles with colored particles, peripheral speed of the extreme end of the stirring blade of the mixing device is preferably from 10 to 50 m/s and more preferably from 10 to 50 m/s.

As a fixing apparatus, can be employed a Henschel mixer, Rödige mixer, TURBO SPHERE mixer, etc. Among them, the Henschel mixer is preferably employed because a mixing process with external additives and a holding process are performed in the same apparatus, and stir mixing, heating and high shearing force from the outside are easily performed.

As the above-mentioned fixing method, a fixing example employed with Henschell mixer is described in detail as follows, wherein shearing force higher than conventional ways is applied. The peripheral speed of the extreme end of the stirring blade is preferably from 5 to 50 m/s and more preferably 10 to 40 m/s. In addition, it is preferred that fine particles are adhered uniformly on the surface of the resin particle through the preliminary mixing. As a method to control temperature, it is preferred that heated water is supplied from the outside and the temperatures is controlled as required.

Regarding the manner of temperature measurement, is measured the temperature of the portion where the toner is moving and flowing under mixing with stirring. Moreover, it is preferred that after the fixing treatment, cooled water is run and cooling and pulverizing processes are performed.

In order to obtain the Releasing Index of the present invention, it is preferred that stir mixing temperature of the fine particles and colored particles in a mixing apparatus satisfies the following relation. $T_g-20 \leqq$(stir mixing temperature$\leqq T_g+20$ In order to adhere fine particles uniformly onto the surface of the colored particle, it is preferred that stir mixing is conducted under the condition of the aforementioned temperature condition, while providing mechanical impact.

In the present invention, $T_g$ represents the glass transition temperature of a toner or a binder resin. The glass transition temperature was measured by the DSC7 Differential Scanning Calorimeter (manufactured by Perkin-Elmer Co.). The measurement method is as follows. Temperature was raised from 0° C. to 200° C. at a rate of 10° C./minute and was lowered from 200° C. to 0° C. at a rate of 10° C./minute in order to erase the hysteresis. Then, the temperature was raised from 0° C. to 200° C. at a rate of 10° C./minute and endothermic peak temperature of second heat was obtained and temperature obtained was termed $T_g$. When there were a plurality of endothermic peaks, the temperature of the main endothermic peak was defined as $T_g$.

As $T_g$ of a toner or a binder resin, 40° to 70° C. is preferably employed. At lower than 40° C., durability of the toner is liable to be degraded and the toner tends to suffer coagulation. At 70° C. or higher, fixability and productivity are liable to be deteriorated.

From a view point of providing fluidity, after controlling the adhesion of fine particles, other particles may be externally added. However, it is required that the Releasing Index fine particles is within the range predetermined by the present invention.

(Cleaning Process by Blade)

By using a device equipped with a blade-shaped cleaning member which is disposed so as to forcibly contact a photoreceptor, residual toner which has not been transferred is cleaned. Contacting pressure of the cleaning member against the photoreceptor is preferably from 5 to 50 g/cm from the standpoint of improvement in cleaning. Moreover, in the step before the cleaning process, it is preferred to provide a discharging process which discharges the surface of the photoreceptor in order to make cleaning efficient. The discharging process is conducted by, for example, a discharging apparatus which generates alternating corona discharge.

Technical contents related to the present invention are practically explained.

(1) Toner Compositions and Preparation Method

The toner of the present invention comprises at least a resin and a colorant and can comprise a releasing agent which improve fixability and a charge control agent, etc. as required. Furthermore, to so-called colored particles composed of a resin and a colorant may be added an external additive comprised of inorganic fine particles or organic fine particles.

As monomers employed for the preparation of the toner of the present invention, are illustrated styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc.; α-methylene fatty acid monocarboxylic acid esters of acrylic acid ester derivatives, etc. such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, etc.; olefins such as ethylene, propylene, isobutylene, etc.; vinyl esters such as vinyl chloride, vinylidene chloride, vinyl bromide, vinyl fluoride, vinylidene fluoride, etc.; vinyl ethers such as vinyl methyl ether, vinyl ethyl ether, etc.; vinyl ketones such as vinyl methyl ketone, vinyl ethyl ketone, vinyl hexyl ketone, etc.; N-vinyl compounds such as N-vinyl carbazole, N-vinyl indole, N-vinyl pyrrolidone, etc.; acrylic acid or methacrylic scid derivatives such as acrylonitrile, methacrylonitrile, acrylamide, etc. These vinyl monomers can be employed individually or in combination.

Resins can be prepared from those monomers using a radical polymerization initiator. In this case, for a suspension polymerization method and a solution polymerization method, an oil-soluble polymerization initiator can be used. As the oil-soluble polymerization initiator, can be employed azoisobutyronitrile, lauryl peroxide, benzoyl peroxide. In addition, for an emulsion polymerization, a water-soluble radical polymerization initiator can be employed. As the water-soluble polymerization initiator, can be illustrated persulfate salts such as potassium persulfate, ammonium persulfate, etc., azobisaminodipropane acetic acid salt, azobiscyanovaleric acid and its salt, hydrogen peroxide, etc.

The toner of the present invention incorporates a various kind of colorants. As the colorants, carbon black, magnetic materials, dyes, pigments, etc. can be optionally employed. As carbon black, are employed Channel Black, Firmness Black, Acetylene Black, Thermal Black, Lamp Black, etc. As the magnetic materials, ferromagnetic metals such as iron, nickel, cobalt, etc., alloys comprising these metals, ferromagnetic metal compounds such as ferrite, magnetite, etc., alloys comprising non-ferromagnetic metal which shows ferromagnetism upon heating, for example, alloys termed Heusler's alloy such as manganese-copper-aluminum, manganese-copper-tin, chromium dioxide, etc. As dyes, can be employed C.I. Solvent Red 1, the said 49, the said 52, the said 58, the said 63, the said 111, the said 122, C.I. Solvent Yellow 19, the said 44, the said 77, the said 79, the said 81, the said 82, the said 93, the said 98, the said 103. the said 104, the said 112, the said 162, C.I. Solvent Blue 25, the said 36, the said 60, the said 70, the said 93, the said 95, etc. Furthermore, a mixture of those dyes can be employed. As pigments can be employed C.I. Pigment Red 5, the said 48:1, the said 53:1, the said 57:1, the said 122, the said 139, the said 144, the said 149, the said 166, the said 177, the said 178, the said 222, C.I. Pigment Orange 31, the said 43, C.I. Pigment Yellow 14, the said 17, the said 93, the said 94, the said 138, C.I. Pigment Green 7, C.I. Pigment Blue 15:3, the said 60 and a mixture of these pigments can be employed. A primary number average particle size varies according to kinds. However, generally, the primary number average particle size is preferably from 10 to 200 nm.

Furthermore, as fixability improving agents, may be employed polypropylene (number average molecular weight=1,500 to 9,000) having a low molecular weight and polyethylene having a low molecular weight. Furthermore, as charge control agents, azo metal complexes and quaternary ammonium salts may be employed.

A particle size of the toner itself of the present invention is optional. However, the toner having the small particle size tends to result in the advantages of the present invention. A volume average particle size is preferably from 2 to 15 μm and more preferably from 5 to 9 μm.

In addition, while the above-described volume average particle size meets the requirement, it is preferable that size distribution of the toner particles is adjusted to the specified distribution by size classification. As the size distribution, 16.0 μm or more is 2.0 volume percent or less and 5.0 μm or less is 16.0 particle number percent or less. When 16.0 μm or more is 2.0 volume percent or more, image sharpness is degraded. When 5.0 μm or less is 16.0 particle number percent or more, transfer ratio decreases due to the increase in the toner which is not transferred.

As a measurement apparatus, the COULTER Counter TA-11 Type (manufactured by COULTER Co.) is used to which the interface (manufactured by Nikaki Co.) which outputs number distribution and volume distribution is connected and a personal computer PC9801 (manufactured by NEC Co., Ltd.) is also connected. As an electrolyte, aqueous 1 percent NaCl solution is prepared using extra pure sodium chloride. The measurement method was as follows. Into from 100 to 150 ml of the above-described aqueous electrolyte was added 0.1 to 5 ml of a surface active agent solution, preferably alkyl benzene sulfonate salt as a dispersing solution. Then, 2 to 20 ml of a sample solution to be measured was added. The electrolyte in which the sample is dispersed is dispersed for about 1 to about 3 minutes by an ultrasonic dispersion device. Then, the particle size distribution was measured by the above-described COULTER Counter TA-11 Type using an aperture of 100 μm as the aperture. As the measurement range, 1.26 to 50.8 μm was employed, Moreover, the measured value of 2.0 μm or less was cut without computation and the above-described values were obtained.

The following cases are considered for use of the toner of the present invention; for example, the toner comprising magnetic substance is employed as a single component toner; the toner is mixed with a so-called carrier and is used as a two component developer and the toner is individually used as a non-magnetic toner, and the like. The toner can be suitably applied to the above cases. However, in the present invention, it is preferred that the toner is mixed with the carrier and is used as the two component developer.

As the carrier composing of the two component developer, may be used any of non-coated carrier which is composed only of particles of magnetic materials such as iron, ferrite, etc. or resin coated carrier wherein the surface of the particle of magnetic materials is covered with resin, etc. An average particle size of the carrier is preferably from 30 to 150 μm in terms of volume average particle size. The resin for covering is not particularly limited. As for example, styrene-acrylic resin can be illustrated.

(2) Embodiment of Imaging Method

As a development process to which the toner of the present invention can be applied, the toner can be preferably applied to a non-contact development process and the like. Especially, the toner of the present invention shows rapid charge rising-up properties and is useful for the non-contact development method. Namely, because in the non-contact development method, variation in a development electric field is large, the variation in minute charging affects highly development itself. On account of the foregoing, the big variation is caused due to variation in a charging amount of the toner. However, since the toner of the present invention shows the high charge rising-up properties, the variation in charging amount is small and can secure the charging amount having no big variation. As a result, even in the non-contact development method, consistent images are prepared for a long period of time.

The development process of the present invention is arranged so that a developing layer which is formed on a developer carrying member and a photoreceptor are not in contact each other. In order to embody this development process, it is preferred that the developing layer is formed to be a thin layer. Accordingly, in this method, the developing layer having a thickness of 20 to 500 μm is formed in the development region on the surface of the developer carrying member (development sleeve) and the gap between the photoreceptor and the developer carrying member is arranged so as to be larger than that of the aforesaid developing layer. The formation of this thin layer is performed by a magnetic blade utilizing magnetic force and a method wherein a developing layer controlling stick is pushed onto the surface of the developer carrying member. Furthermore, there is another method wherein the developing layer is controlled by contacting urethane blade, phosphor bronze plate, etc. on the surface of the developer carrying member. Suitable pushing pressure of the pushing pressure control member is from 1 to 15 gf/mm. When the pushing pressure is small, transportation tends to be unstable due to the shortage of the control force. On the other hand, when the pushing pressure is large, the impact to the developer becomes large and durability of the developer tends to be lowered. More preferred range is from 3 to 10 gf/mm.

Furthermore, when development bias is applied at development, alternating current bias is applied in addition to direct current component.

As the dimension of the developer carrying member, 10 to 40 mm in the diameter is suitable, When the diameter is small, mixing the developer becomes insufficient and it becomes difficult to secure enough mixing so as to provide enough charge to the toner. When the diameter is large, the centrifugal force becomes large for the developer and a problem such as toner scatter is liable to be caused.

In the following, one embodiment of the non-contact development process is explained, referring to FIG. 1.

FIG. 1 is a schematic diagram of a development portion of a non-contact development process which is suitably employed by the imaging method of the present invention. Numeral 1 is a photoreceptor, 2 is a developer carrying member, 3 is a two component developer comprising the toner of the present invention, 4 is a developing layer regulating member, 5 is a development region, 6 is a developing layer, 7 is a power source for forming alternating electric field.

The two component developer comprising the toner of the present invention is hold by magnetic force on the developer carrying member 2 which comprises internally a magnet 2B and is transported to the development region 5 by the movement of a development sleeve 2A. At the transportation, the thickness of the developing layer 6 is controlled by the developing layer regulating member 4 in the development region 5 so that it has no contact to the photoreceptor 1.

The minimum gap distance (Dsd) in the development region 5 is larger, for example, from about 100 to about 1,000 μm than the thickness (preferably from 20 to 500 μm) of the developing layer 6. The power source 7 for forming the alternating electric field supplies preferably alternating current of frequency of 1 to 10 kHz and voltage in absolute value of 0.1 to 3 kVp-p. The power source 7 may have a composition in which direct current is wired in series to alternating current. Voltage of the direct current is preferably from 100 to 800 V.

When the toner of the present invention is applied to color imaging process, the process is such that on a photoreceptor, a monochromatic image is formed a plurality of times by development and the resulting images are transferred simultaneously to an image supporting member.

The developer carrying member of the present invention has a built-in magnet in the inside. The surface of the developer carrying member is composed of aluminum, aluminum of which surface undergoes oxidation treatment or stainless steal.

The toner image which is formed on the photoreceptor by the above-described various methods is transferred to an image transferring material such as normal paper, etc. Transferring process is not particularly limited and various transferring processes such as corona transferring process, roller transferring process, etc. are available.

The toner which remains on the photoreceptor, after the toner image is transferred to the image transferring material is removed by cleaning and the photoreceptor is repeatedly employed.

Figure 2:
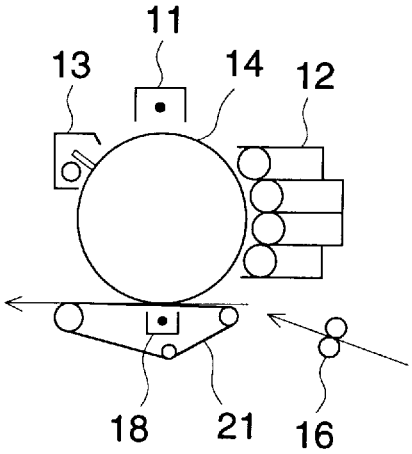

In FIG. 2, 11 is a charger; 12 is a developing device; 13 is a cleaning unit; 14 is a photoreceptor drum; 16 is a transporting unit; 18 is an image transferring electrode and 21 is a transferring unit.

Referring to FIG. 2, processes of the successive transfer method are explained. Image formation is performed in the embodiment wherein around the circumference of a laminated-type organic photoreceptor drum 14 comprising a photosemiconductor in which an electrostatic latent image is formed on a conductive substrate, there are arranged, near to the photoreceptor drum 14, a charger 11 which provides charge onto the surface of the photoreceptor drum 14, and a developing unit 12 in which a plurality of developing devices into which a monochromatic toner is supplied, and on the photoreceptor drum 14, a cleaning unit 13 is arranged which cleans the remaining toner on the photoreceptor drum 14. In another zone, are arranged a transporting unit 16 which supplies transfer materials. The monochromatic toner image on the photoreceptor drum 14 is transferred by the transferring electrodes 18 in the transfer zone to the image transfer material which is supplied from the transporting unit 16.

A multicolor image is prepared by fixing the transferring material with the use of a fixing device mentioned hereinafter.

Image formation in the simultaneous transfer process shown in FIG. 2 is conducted in the following way. On the photoreceptor drum, multicolored toner images are superimposed (in this case, the cleaning unit 13 and the transferring electrode 18 are not operated.) and lastly, are simultaneously transferred to the transferring material using the transferring unit 21.

Moreover, in the aforementioned FIG. 2, generally, a photoreceptor is negatively charged. Exposure was performed by a semiconductor laser beam in accordance with an image and a reversal developing method was employed which was performed to the exposed part. In the present invention, as the cleaning mechanism, is employed a blade cleaning method using a so-called cleaning blade.

Figure 3:
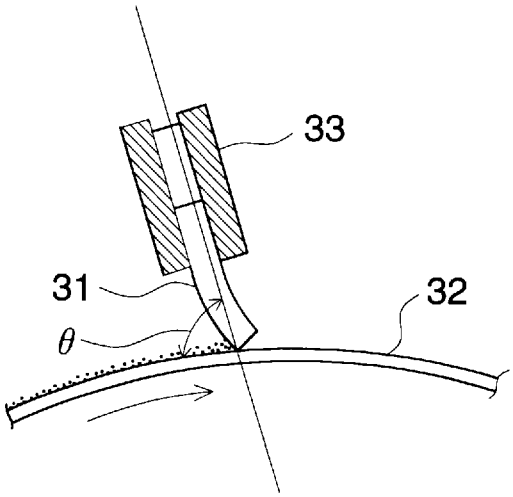
Figure 4:
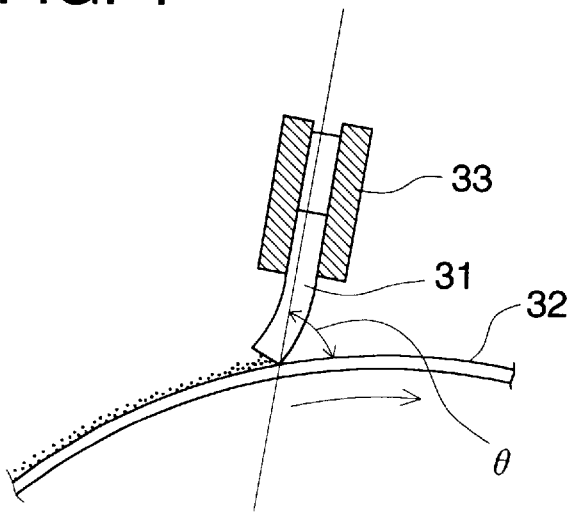

As the arrangement, any arrangement shown in FIGS. 3 and 4 can be employed. In FIGS. 3 and 4, a holder 33 is disposed so as to hold a cleaning blade 31. Moreover, a photoreceptor is designated as the numeral 1. Regarding an angle formed by the holder and the photoreceptor, $\theta_1$ shown in both FIGS. 3 and 4 is 10° to 90° and preferably 15° to 75°. As a material composing of the blade itself, can be used an elastic material such as silicone rubber, urethane rubber, etc. In this case, the rubber hardness is preferably from 30° to 90°. The thickness is preferably from 1.5 to 5 mm and the external length of the blade portion is preferably from 5 to 20 mm. In the present invention, the rubber hardness is defined as Asuka C hardness. Furthermore, Asuka C test is performed as follows.

Asuka C test is for testing the hardness of the object.

Figure 5:
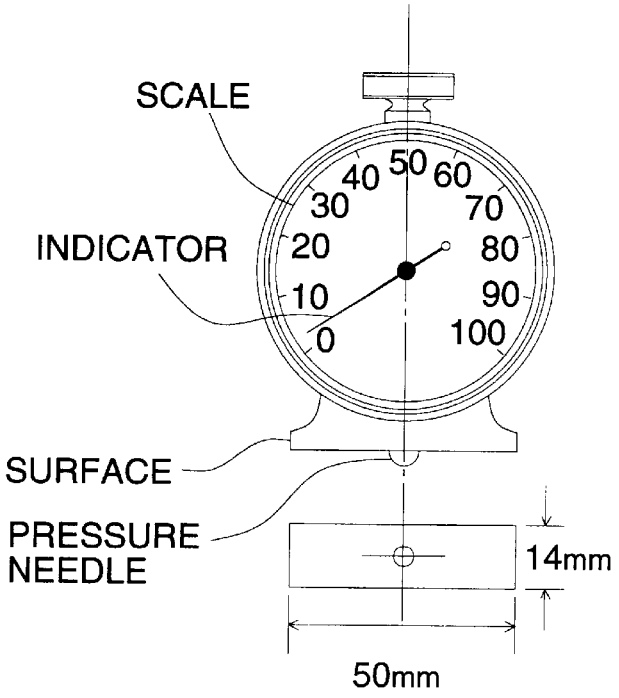
Figure 5:
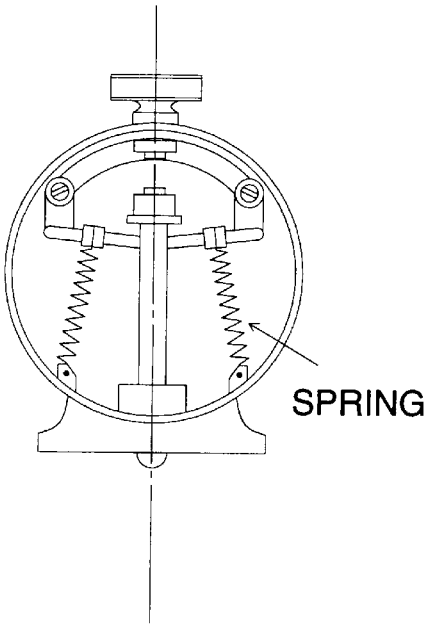
Figure 5:
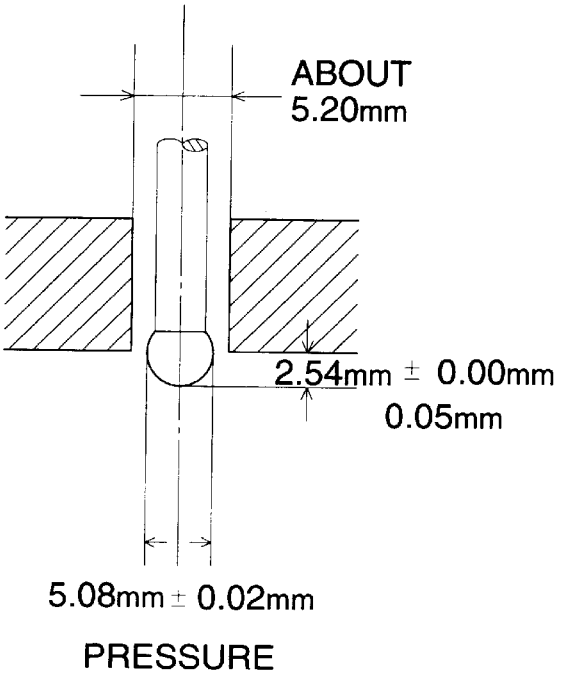

As shown in FIGS. 5(*a*), 5(*b*) and 5(*c*), Asuka C test is executed with the instrument regulated by the regulations shown in Table A.

However, for the test, the instrument is applied to the object until the object is in contact with the pressure surface, and the indicator is read.

Since the pressure needle of the instrument is protruded 2.54 mm from the pressure surface, if the object has an elasticity not less than the maximum elasticity of the test, the needle is pushed into the instrument completely by the object so that the indicator indicates 100°.

Otherwise, the indicator displays the hardness of the object according to the elasticity of the object with a number between 0° and 100°.

TABLE A

| TEST | NEEDLE MAXIMUM HEIGHT | SIZE FIGURE OF NEEDLE | SPRING AT 0° | LOAD AT 100° |
|---|---|---|---|---|
| ASUKA C | 2.54 mm | FIG. 10 | 55 g | 855 g |

EXAMPLE

In the following, referring to an example of embodiment, the present invention is explained in detail. The embodiment of the present invention is not limited to the embodiment herein. Moreover, parts are by weight unless otherwise described.

(Preparation of Colored Particle)

As described in the following, colored particles were prepared.

Polyester resin 100 parts (Tg=55.1° C.), carbon black 10 parts and polypropylene 3 parts were mixed, kneaded, pulverized and classified and powder was obtained wherein an average diameter was 8.5 μm and 16.0 μm or more is 0.1 volume percent and 5.0 μm or less is 9.01 particle number percent. This was termed colored particle 1.

Colored particles were prepared by the same method as the above except for the colorant. The colored particles in which yellow pigment was used as a colorant were termed colored particle 2. The colored particles in which magenta pigment was used were termed colored particle 3. The colored particles in which cyan pigment was used were termed colored particle 4.

(Fine Particle)

TABLE 1

| Fine Particle No. | Particle Number Average Particle Size | Composition |
|---|---|---|
| 1 | 0.05 | Titanium oxide |
| 2 | 0.07 | Silica |
| 3 | 0.10 | Styrene/MMA |
| 4 | 0.20 | Melamine-formaldehyde |
| 5 | 0.50 | Titanium oxide |
| 6 | 0.01 | Silica |
| 7 | 0.03 | Titanium oxide |
| 8 | 1.00 | Titanium oxide |

(Example of Toner Preparation)

The aforementioned colored particle 100 parts and fine particle (refer to the table regarding the addition parts) were mixed by the Henschel mixer (FM-10B) and toners of the present invention were prepared by changing variously the temperature and peripheral speed externally controlled. The toners obtained are shown in Table 2.

TABLE 2

| Toner No. | Colored Particle | Fine Particle | | Condition | Releasing Index in terms of turbidity |
|---|---|---|---|---|---|
| 1 | 1 | 1 (1.2) | — | 2 | 15 |
| 2 | 2 and 3 | 2 (1.2) | — | 2 | 20 |
| 3 | 2 and 4 | 1 (1.2) | 6 (0.6) | 2 | 20 |
| 4 | 2 | 2 (1.2) | 6 (0.6) | 2 | 18 |
| 5 | 3 and 4 | 3 (1.2) | 6 (0.6) | 3 | 32 |
| 6 | 2 and 3 | 4 (1.2) | 6 (0.6) | 4 | 30 |
| 7 | 2 and 4 | 5 (1.2) | 6 (0.6) | 4 | 35 |
| 8 | 1 | 6 (1.2) | 6 (0.6) | 3 | 16 |
| 9 | 3 | 7 (1.2) | 6 (0.6) | 3 | 30 |
| 10 | 2 and 3 | 8 (1.2) | 6 (0.6) | 4 | 40 |
| 11 | 2 and 4 | 1 (1.2) | 6 (0.6) | 4 | 5 |
| 12 | 2 | 1 (1.2) | 6 (0.6) | 1 | 65 |

Figures in the parentheses in Fine Particle column are addition parts by weight.

Condition 1: Stir mixing temperature 25° C.=Tg−30, Peripheral speed of top of stirring blade 40 m/s Condition 2: Stir mixing temperature 40° C.=Tg−15, Peripheral speed of top of stirring blade 30 m/s Condition 3: Stir mixing temperature 55° C.=Tg, Peripheral speed of top of stirring blade 30 m/s Condition 4: Stir mixing temperature 65° C.=Tg+10, Peripheral speed of top of stirring blade 20 m/s (Measurement of Releasing Index)

A practical dispersion method is such that in a 100 ml beaker, is put 5.0 g of the toner which has been processed by an external additive; then, 50 ml of an aqueous solution containing 1 ml of a 35 percent aqueous solution of alkyl benzene sodium sulfate salt (trade name=FAMILY manufactured by Kao Corp.) is added; the resulting mixture is stirred by a magnetic stirrer for five minutes and the toner is dispersed into water with the aid of the surface active agent. Then, the aforesaid aqueous solution into which the toner is dispersed is subjected to centrifugal separation at 2,000 rpm (300 G) for ten minutes by the 30CFS centrifugal separator manufactured by Sakuma Seisakusho. Next, 40 ml of the supernatant is collected and the Releasing Index of the present invention is obtained by measuring the light transmittance at a wavelength of 500 nm using the COH-300A having a halogen lamp as a light source, manufactured by Nihon Denshoku Co.

(Preparation of Carrier)

Fine particles of copolymer of styrene/methyl methacrylate=4/6 60 g and Cu-Zn ferrite particles 1,940 g having a specific gravity of 5.0, a weight average particle size of 45 μm, and a saturation magnetization of 35 emu/g when external magnetic field was applied were put in a high speed mixing apparatus and were mixed at 30° C. of carrier particle temperature for 15 minutes. Then, the carrier particle temperature was set at 105° C. and mechanical impact force was applied repeatedly for 30 minutes. Then, a carrier was prepared by chilling the resulting.

(Preparation of Developer)

Each carrier 558 g and each toner 42 g were mixed by a V-type mixer for 20 minutes and the developer for testing practical imaging was prepared. Each number of the developers is the same as that corresponding to each toner.

(Apparatus for Evaluation)

The Color copying machine Konica 9028 manufactured by Konica Corp. was modified as follows and was employed.

(Developing Conditions)

Surface potential of photoreceptor=−750 V

DC bias=−650V

AC bias: Vp−p=1.8 kV, Frequency=8 kHz

Dsd (nearest approaching distance between photoreceptor and developing sleeve)=500 μm Pushing pressure control force=10 gf/mm Pushing pressure control stick=SUS416 (magnetic stainless steel)/diameter 3 mm Developing Sleeve=diameter 20 mm Thickness of developing layer=150 μm (Evaluation Items)

Developers prepared as mentioned above were employed. The developers 1 to 12 each were put in the modified Color copying machine Konica 9028 manufactured by Konica Corp. and practical imaging test was performed.

The test was performed by making 40,000 copies with practical imaging. At the test, were evaluated transfer ratio, formation of white spot and occurring situation of poor cleaning.

Transfer ratio

A patch having an original density of 1.3 was developed and a toner image was transferred to a sheet of ordinary paper. Then, before fixing, mechanical operation was stopped and the transfer ratio was obtained as being defined as $\{A/(A+B)\}\times 100$, wherein A represents the amount of toner per unit area on transfer paper and B represents the amount of toner per unit area which remains on the photoreceptor.

Moreover, when two kinds of developers were combined, the transfer ratio of a part of the superimposed colored toner images was measured.

The transfer ratio was measured at every 5,000 copy and the average transfer ratio was classified into 4 ranks and was evaluated.

A: 92 percent or more

B: 85 to 92 percent

C: 70 to 85 percent

D: 70 percent or less

The frequency of the formation of the imperfect transfer was classified and evaluated as follows.

| | |
|---|---|
| Rank A | perfectly no formation |
| Rank B | 1 spot/10,000 copies or less |
| Rank C | 1 spot/1,000 copies or less |
| Rank D | 1 spot/1,000 copies or more |

Poor Cleaning

Every 5,000 copy, the surface of the drum was observed and poor cleaning (filming, scratch on the drum) was inspected.

TABLE 3

| Developer No. | Releasing Index in terms of turbidity | Transfer Ratio | The Imperfect Transfer | Poor Cleaning |
|---|---|---|---|---|
| 1 | 15 | A | A | None |
| 2 | 20 | A | A | None |
| 3 | 20 | A | A | None |
| 4 | 18 | A | A | None |
| 5 | 32 | A | A | None |
| 6 | 30 | A | A | None |
| 7 | 35 | A | A | None |

TABLE 3-continued

| Developer No. | Releasing Index in terms of turbidity | Transfer Ratio | The Imperfect Transfer | Poor Cleaning |
|---|---|---|---|---|
| 8 | 16 | D | B | Filming formation at 10,000 copy |
| 9 | 30 | C | B | Filming formation at 20,000 copy |
| 10 | 40 | B | C | Drum crack formation at 500 copy |
| 11 | 5 | C | C | Filming formation at 10,000 copy |
| 12 | 65 | B | D | Filming formation at 1,000 copy |

The developers No. 1 to 7 of the present invention showed excellent results for all items of transfer ratio, imperfect transfer and poor cleaning. On the other hand, it is found that developers No. 8 to 12 not in the scope of the present invention are inferior in all items.

What is claimed is:

1. A toner for developing an electrostatic latent image, comprising colored particles containing a colorant and a binder resin, and fine particles, wherein said toner have a releasing index of 10 to 50 in terms of a turbidity.

2. The toner of claim 1, wherein said fine particles have a number average particle size of 0.05 to 0.5 μm.

3. The toner of claim 1, wherein an amount of said fine particles is 0.05 to 5.0 parts by weight of said colored particles.

4. The toner of claim 1, wherein said fine particles are inorganic fine particles selected from a group consisting of silica, alumina, titania, zirconia, barium titanate, aluminum titanate, strontium titanate, magnesium titanate, zinc oxide, chromium oxide, selenium oxide, antimony oxide, tungsten oxide, tin oxide, tellurium oxide, manganese oxide, boron oxide, silicon carbide, boron carbide, titanium carbide, silicon nitride, titanium nitride and boron nitride.

5. The toner of claim 4, wherein said inorganic fine particles are processed with a hydrophobicity providing agent.

6. The toner of claim 5, wherein said inorganic fine particles have a hydrophobicity of not less than 20 in terms of methanol wetability.

7. The toner of claim 5, wherein said hydrophobicity providing agent is an agent selected from a group consisting of a titanium coupling agent, a silane coupling agent, aluminum stearate, zinc stearate and calcium stearate.

8. The toner of claim 1, wherein said fine particles are organic fine particles selected from the group consisting of melamine-formaldehyde condensation products, polyesters, polycarbonates, polyamides, and polyurethanes.

9. The toner of claim 1, wherein said toner is prepared by a method comprising a step of mixing said colorant particles and said fine particles in a mixing apparatus having a stirring blade, wherein a peripheral speed of said stirring blade is 5 to 50 m/s.

10. The toner of claim 1, wherein said toner is prepared by a method comprising a step of mixing said colorant particles and said fine particles in a mixing apparatus having a stirring blade at a stir mixing temperature satisfying the following relation:

$Tg-20 \leqq \text{stir mixing temperature} \leqq Tg+20$ wherein Tg represents a glass transition temperature of said toner or said binder resin.

11. The toner of claim 10, wherein said glass transition temperature is 40° to 70° C.

12. The toner of claim 1, wherein said toner has a volume average particle size of 2 to 15 $\mu$m.

13. The toner of claim 1, wherein said toner has a volume average particle size of 5 to 9 $\mu$m.

14. The toner of claim 1, wherein said fine particles are adhered electrostatically onto surface of said colored particles.

15. The toner of claim 2 wherein an amount of said fine particles is 0.05 to 5.0 parts by weight of said colored particles.

16. The toner of claim 2 wherein said fine particles are inorganic fine particles selected from a group consisting of silica, alumina, titania, zirconia, barium titanate, aluminum titanate, strontium titanate, magnesium titanate, zinc oxide, chromium oxide, selenium oxide, antimony oxide, tungsten oxide, tin oxide, tellurium oxide, manganese oxide, boron oxide, silicon carbide, boron carbide, titanium carbide, silicon nitride, titanium nitride and boron nitride.

17. The toner of claim 2 wherein said fine particles are organic fine particles selected from the group consisting of melamine-formaldehyde condensation products, polyesters, polycarbonates, polyamides, and polyurethanes.

18. The toner of claim 4 wherein said inorganic fine particles have a hydrophobicity of not less than 20 in terms of methanol wetability.

19. A toner for developing an electrostatic latent image comprising colored particles containing a colorant, a binder resin, and fine particles having a number average particle size of 0.05 to 0.05 $\mu$m, an amount of said fine particles being 0.05 to 5.0 parts by weight based on said colored particles, wherein said toner has a releasing index of 10 to 50 in terms of turbidity, and said fine particles are selected from the group consisting of silica, alumina, titania, zirconia, barium titanate, aluminum titanate, strontium titanate, magnesium titanate, zinc oxide, chromium oxide, selenium oxide, antimony oxide, tungsten oxide, tin oxide, tellurium oxide, manganese oxide, boron oxide, silicon carbide, boron carbide, titanium carbide, silicon nitride, titanium nitride and boron nitride.

* * * * *